US006153368A

United States Patent [19]

Schwark et al.

[11] Patent Number: 6,153,368

[45] Date of Patent: Nov. 28, 2000

[54] BACKSIDE PROTECTIVE OVERCOAT COMPOSITIONS FOR SILVER HALIDE PHOTOGRAPHIC ELEMENTS

[75] Inventors: Dwight W. Schwark, Rochester; Yongcai Wang, Webster; Charles C. Anderson, Penfield, all of N.Y.

[73] Assignee: Eastman Kodak Company, Rochester, N.Y.

[21] Appl. No.: 09/431,729

[22] Filed: Nov. 1, 1999

Related U.S. Application Data

[63] Continuation-in-part of application No. 09/019,065, Feb. 5, 1998, Pat. No. 5,998,118.

[51] Int. Cl.[7] ..... G03C 1/89; G03C 1/93; G03C 1/76

[52] U.S. Cl. ..... 430/527; 430/529; 430/536; 430/961

[58] Field of Search ..... 430/536, 527, 430/961, 537, 529

[56] References Cited

U.S. PATENT DOCUMENTS

| | | | |
|---|---|---|---|
| 4,582,784 | 4/1986 | Fukugawa et al. | 430/536 |
| 4,612,279 | 9/1986 | Steklenski et al. | 430/536 |
| 4,735,086 | 4/1988 | Steklenski et al. | 524/32 |
| 5,173,739 | 12/1992 | Kurachi et al. | 356/124 |
| 5,466,536 | 11/1995 | Berner et al. | 430/536 |
| 5,597,680 | 1/1997 | Wang et al. | 430/536 |
| 5,597,681 | 1/1997 | Anderson et al. | 430/536 |
| 5,643,972 | 7/1997 | Wang et al. | 523/206 |
| 5,681,688 | 10/1997 | Takamuki | 430/537 |
| 5,695,919 | 12/1997 | Wang et al. | 430/536 |
| 5,786,135 | 7/1998 | Anderson et al. | 430/536 |
| 5,866,285 | 2/1999 | Anderson et al. | 430/536 |
| 5,998,118 | 12/1999 | Schwark et al. | 430/536 |

FOREIGN PATENT DOCUMENTS

| | | |
|---|---|---|
| 643 326 | 3/1995 | European Pat. Off. . |
| 476 535 | 8/1997 | European Pat. Off. . |
| 829 759 | 3/1998 | European Pat. Off. . |
| 196 40 208 | 4/1998 | Germany . |

*Primary Examiner*—Richard L. Schilling
*Attorney, Agent, or Firm*—Doreen M. Wells

[57] ABSTRACT

A photographic element which includes a support having a frontside and a backside, at least one silver halide emulsion layer superposed on the frontside of the support; and a protective overcoat layer superposed on the backside of the support. The protective overcoat layer is formed from a coating solution comprising a continuous liquid organic medium having therein a mixture of dispersed core/shell polymer particles and a soluble polymer. The core/shell polymer particles comprise a core portion, which is insoluble in the organic medium, and a shell portion which has an affinity for both the core portion and the organic medium and has an acid number of from 25 to 200. The soluble polymer has an acid number of from 70 to 500 and the acid number of the soluble polymer is greater than the acid number of the shell of the core/shell polymer particles.

15 Claims, No Drawings

BACKSIDE PROTECTIVE OVERCOAT COMPOSITIONS FOR SILVER HALIDE PHOTOGRAPHIC ELEMENTS

CROSS-REFERENCE TO RELATED APPLICATION

This is a continuation-in-part of application Ser. No. 09/019,065, filed Feb. 5, 1998, now U.S. Pat. No. 5,998,118, entitled NOVEL BACKSIDE PROTECTIVE OVERCOAT COMPOSITIONS FOR SILVER HALIDE PHOTOGRAPHIC ELEMENTS.

FIELD OF THE INVENTION

The present invention relates to a photographic element with improved physical properties of its backside protective overcoat. In particular, the present invention relates to photographic elements having a backside protective overcoat which provides the elements with excellent barrier properties, excellent resistance to surface haze or scum formation and blistering during photographic processing, and excellent protection against mechanical scratch and high humidity ferrotyping.

BACKGROUND OF THE INVENTION

Photographic light-sensitive materials are generally composed of light-sensitive photographic emulsion layers and light insensitive layers such as an interlayer, an emulsion protective layer, a filter layer, or an antihalation layer applied, directly or indirectly through a subbing layer, to one side or both sides of the support consisting of, for example, an α-olefin such as polyethylene, a cellulose ester such as cellulose acetate or nitrocellulose, a polyester such as polyethylene terephthalate or polyethylene napththalate, polystyrene, paper, or a synthetic paper. In light-sensitive materials such as color photographic elements, auxiliary layers such as an antistatic layer, a curl preventing layer, a magnetic recording layer, a barrier layer, a scratch resistant overcoat layer, or a surface lubricant layer, are provided on the backside of the support in order to enhance the photographic or physical quality of the photographic light-sensitive materials.

It is always desirable to have a backside protective overcoat that serves as many functions as possible in order to reduce manufacturing complexity and cost. It is also desirable to have such a layer formed by coating and drying from coating compositions based on solvents that are less hazardous to the environment.

Prior art has disclosed the use of a protective overcoat or a "barrier" layer to maintain post-process conductivity of an antistatic layer. Typically such protective overcoats consist of hydrophobic materials such as cellulose acetates, cellulose acetate butyrates, cellulose acetate propionates, cellulose nitrates, polyacrylates, polymethacrylates, polystyrene, and poly(vinyl acetal).

When such hydrophobic barrier layers are used as an outermost surface layer, deposition of material or "scum" formation on the outermost surface following photographic processing is commonly seen. For example, U.S. Pat. No. 4,735,976, incorporated by reference herein, discusses how surfactant from the final photographic processing solution, known as the stabilizer solution, can form a deposit on the outermost surface layer and thereby lead to an objectionable surface haze or scum. Similarly, U.S. Pat. No. 4,582,784, incorporated by reference herein, discusses the occurrence of spotted drying unevenness on the outermost surface.

Another type of processing scum that is particularly troublesome is hard-water scum. Processing laboratories that are located in hard-water areas are particularly susceptible to this problem. After processing in solutions prepared using hard-water, a white hazy surface scum, sometimes uniform and sometimes more liney and streaky, can be seen on the film. Chemical analysis of the hard-water scum typically reveals hard-water salts of calcium, magnesium, and sodium.

Such surface deposits can impact the physical performance of the element in a variety of ways. For example, large deposits of material on a photographic film lead to readily visible defects on photographic prints or are visible upon display of motion picture film. Alternatively, post-processing debris can influence the ability of a processed film to be overcoated with an ultraviolet curable abrasion resistant layer, as is done in professional photographic processing laboratories employing materials such as PhotoGard, 3M. Finally, processing residue on photographic elements can impact the ability to read or write magnetically recorded information on a processed film, such as the new Advanced Photographic System film.

U.S. Pat. Nos. 4,612,279 and 4,735,976, incorporated by reference herein, describe a protective overcoat comprising a blend of cellulose nitrate and a copolymer containing acrylic or methacrylic acid for eliminating objectionable surface haze or scum formed during photographic processing. U.S. Pat. No. 4,582,784 describes an uppermost surface layer composed of a hydrophobic cellulose ester polymer and a hydrophilic vinyl polymer for reducing spotted drying unevenness. However, layer compositions disclosed in the above art do not provide adequate barrier properties and adequate resistance to mechanical scratch and high humidity ferrotyping. High humidity ferrotyping becomes a problem especially for photographic systems such as the so-called Advanced Photographic System where the processed element may be re-introduced into a cassette. Such a system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739, incorporated by reference herein, discloses a cassette designed to thrust the photographic element from the cassette, eliminating the need to contact the film by mechanical or manual means. Published European Patent Application 0 476 535 A1 describes how the developed film may be stored in such a cassette. The dimensions of such a so-called thrust cassette require that the processed photographic element be wound tightly and under pressure, causing direct close contact between the front and back sides which results in ferrotyping, especially at high temperature and high relative humidity.

U.S. Pat. Nos. 5,597,680, 5,597,681, and 5,695,919, incorporated by reference herein, describe coating layer compositions comprising a dispersion of core/shell polymer particles, wherein the core portion may be impregnated with a lubricant, in a liquid organic medium. Furthermore, such coating compositions may comprise a solution polymer soluble in the desired solvent medium. Examples of solution polymers utilized in U.S. Pat. Nos. 5,597,680, 5,597,681, and 5,695,919 include polymethylmethacrylate (Elvacite 2041) and nitrocellulose. Solution polymers comprising acid functional groups are not discussed. Coating layers based on U.S. Pat. Nos. 5,597,680, 5,597,681, and 5,695,919 provide photographic elements with excellent barrier properties and excellent resistance to mechanical scratch and ferrotyping at high temperature and in moist environments. However, such coating compositions do not provide the photographic elements with adequate protection against surface haze or scum formation under more severe processing conditions.

U.S. Pat. No. 5,466,536 describes coating layers comprising copolymers of styrene, alkylstyrene, (alkyl)acrylic acid, and (alkyl)acrylic acid alkylester. Examples show aqueous coating compositions comprising aqueous dispersions of such copolymers. Typically two aqueous copolymer dispersions are used where each copolymer has a different level of acid containing monomers. Blends of higher and lower level acid containing copolymers are discussed. However, extension to an organic solvent medium and to one which contains a mixture of solvent dispersible polymer particles and a solvent soluble polymer is not anticipated based on this patent, nor the other prior art patents.

Blisters are characteristic defects that are often observed on the backside of a developed film. When viewed by reflected light, the defect appears as a circular-shaped topographic feature with a wrinkled surface texture. The diameter of the blister can be as large as several millimeters. Blisters not only affect the photographic image quality, but also the read and write ability of a magnetic layer and the image digitization, for example, by a scanner.

The objective of the present invention is to provide a photographic element with a backside protective overcoat composition that meets all of the physical and mechanical requirements as described above while avoiding the problems and limitations of the prior art.

SUMMARY OF THE INVENTION

The present invention is a photographic element which includes a support having a frontside and a backside, at least one silver halide emulsion layer superposed on the frontside of the support; and a protective overcoat layer applied from an organic solvent superposed on the backside of the support. The protective overcoat layer is formed from a coating solution comprising a continuous liquid organic medium having therein a mixture of dispersed core/shell polymer particles and a soluble polymer. The core/shell polymer particles comprise a core portion, which is insoluble in the organic medium, and a shell portion which has an affinity for both the core portion and the organic medium and has an acid number of from 25 to 200. The soluble polymer has an acid number of from 70 to 500 and the acid number of the soluble polymer is greater than the acid number of the shell of the core/shell polymer particles. The protective overcoats prepared in accordance with this invention surprisingly provide both excellent barrier properties and excellent resistance to surface haze or scum formation during photographic processing. As demonstrated by the limitations of the prior art, simultaneously achieving these properties has proven to be extraordinarily difficult.

DESCRIPTION OF THE INVENTION

The photographic elements of this invention can vary greatly in regard to the type of the support. Typical supports include cellulose nitrate film, cellulose acetate film, poly (vinyl acetal) film, polystyrene including syndiotatic polystyrene film, polycarbonate film, poly(ethylene terephthalate) film, poly(ethylene naphthalate) film, glass, metal plate, paper, polymer coated paper, and the like. The support may be annealed. The thickness of the support is not critical. Support thickness of 2 to 10 mils (0.002 to 0.010 inches) can be used. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer.

The present invention contemplates a photographic element that comprises a support, at least one silver halide emulsion layer superposed on the frontside of the support, and a protective overcoat layer on the backside of the support comprising a mixture of core/shell polymer particles and soluble polymer in a continuous organic solvent medium. The core/shell polymer particles comprise a core portion which is insoluble in the organic medium (but may be swellable) and a polymeric shell portion which has an affinity for both the core portion and for the continuous solvent medium.

The shell portion has affinity for both the core portion and for the continuous solvent medium. The first affinity pertains to the ability of the shell molecule to associate with the core portion physically or by covalent bond formation, whereas the affinity for the continuous phase is that the shell molecules are compatible with the continuous solvent phase. In addition, the shell portion comprises sufficient acid functional monomers such that it has an acid number of from 25 to 200. The acid number is defined as the number of milligrams of potassium hydroxide needed to neutralize one gram of polymer. Preferably the shell of the polymer particle has an acid number of from 40 to 150.

The weight of core portion to shell portion is about 90:10 to 30:70, more preferably 80:20 to 40:60, and most preferably 75:25 to 50:50. The core portion has a mean particle size of about from 10 to 500 nm, preferably 10 to 200 nm as measured at its dry state, for example, by electron microscopy.

In one of the preferred embodiments, the polymer particles are composed of a core portion which is crosslinked by using about 1 to 20 parts of crosslinking agents and a shell portion which is grafted to the core portion by covalent bonding. Such particles can be made as core/shell particles by using the methods described in detail in U.S. Pat. Nos. 5,597,680, 5,597,681, and 5,695,919.

Ethylenically unsaturated monomers which may be used in the core portion of the polymer particles of the present invention may include acrylic monomers, such as acrylic acid, or methacrylic acid, and their alkyl esters such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, 2-hydroxyethyl acrylate, 2-hydroxyethyl methacrylate, and 2-hydroxypropyl methacrylate, and the nitrile and amides of the same acids such as acrylonitrile, methacrylonitrile, acrylamide and methacrylamide. Other monomers which may be used, either alone or in admixture with these acrylic monomers, include vinyl acetate, vinyl propionate, vinylidene chloride, vinyl chloride, and vinyl aromatic compounds such as styrene, t-butyl styrene and vinyl toluene. Other comonomers which may be used in conjunction with any of the foregoing monomers include dialkyl maleates, dialkyl itaconates, dialkyl methylene malonates, isoprene, and butadiene.

Preferred crosslinking and grafting comonomers which may be used, in order to crosslink the core portion of the polymer particles and graft the shell portion to the core portion, are monomers which are polyfunctional with respect to the polymerization reaction, including esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, dienes such as butadiene and isoprene, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctional aromatic compounds such as divinyl benzene.

The core portion of the dispersible particles in the present invention can be made in the presence of a certain amount of pre-polymers, or functionalized oligomers, or macromonomers, which may include, for example, functionalized organosiloxanes prepared by reactions between organohydrosiloxane and multifunctional unsaturated monomers, fluorine-containing prepolymers, polyester urethanes, polyether urethanes, polyacrylourethanes, and the like.

The core portion of the dispersible particles in the present invention can be rubbery or glassy at room temperature, that is, the glass transition temperature of the core portion can be higher or lower than room temperature. The core portion can contain one phase or two or more incompatible phases. The incompatibility may be determined in various ways known in the art. The use of scanning electron microscopy using staining techniques to emphasize the differences between the appearance of the phases, for example, is such a technique.

The core portion can be impregnated with a lubricant (as per U.S. Pat. No. 5,695,919) and is insoluble but may be swellable in the solvent medium. The amount of the lubricant incorporated into the polymer particle is from about 1 to 80% by weight, preferably 5 to 50% by weight, and most preferably from 5 to 40% by weight. The shell portion of the dispersible particle in the present invention may include any polymers which have affinity with both the core portion of the particle and the solvent medium. The role of the polymer is to keep the particles apart so that the attraction force between the particles become insignificant and the stability of the dispersion is retained during storage and under shear (see, for example, Sato, T, in Journal of Coating Technology, Vol. 65, No. 825, pages 113 to 121, 1993). The type of polymers that can be used include both homopolymers and copolymers. The shell polymers can be physically attached to the core portion or be chemically attached to the core portion by post polymerization reactions. The shell polymer of the present invention is properly designed to have good compatibility in the solvent medium. Defining compatibility of the shell molecules in the solvent medium can be achieved by using the concept of "polymer solubility map" (see. for example, Ramsbotham, J, in Progress in Organic Coatings, Vol 8, Pages 113–141, 1980, and Wicks, Jr. Z. W., Jones, F. N, and Papas, S. P. in Organic Coatings, pages 229–239, 1992, John Wiley & Sons, Inc.). As the organic solvent, any of the members customarily used in coating compositions may be satisfactorily used.

The shell portion of the particles in the present invention may include reactive functional groups, besides carboxyl, capable of forming covalent bonds by intermolecular crosslinking or by reaction with a crosslinking agent. Suitable reactive functional groups include: hydroxyl, carbodiimide, epoxide, aziridine, vinyl sulfone, sulfonic acid, active methylene, amino, amide, allyl, and the like.

The soluble polymer of the present invention can be any polymer having an acid number of from 70 to 500 such that it is soluble in the desired organic solvent medium used to disperse the core/shell polymer particles. The acid number of the soluble polymer is greater than the acid number of the shell of the core/shell polymer particles and is preferably between 80 and 250.

Soluble polymers useful for the present invention include those obtained by interpolymerizing one or more ethylenically unsaturated monomers containing carboxylic acid groups with other ethylenically unsaturated monomers including, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrenecarboxylic acid.

When the polymerization is carried out using a hydroxyl-containing monomer such as a C2–C8 hydroxyalkyl esters of acrylic or methacrylic acid, a vinyl polymer containing a hydroxyl group as well as a carboxyl group can be obtained.

Soluble polymers according to the present invention may be prepared by conventional solution polymerization methods, bulk polymerization methods, emulsion polymerization methods, suspension polymerization methods, or dispersion polymerization methods. The polymerization process is initiated in general with free radical initiators Free radicals of any sort may be used. Preferred initiators include persulfates (such as ammonium persulfate, potassium persulfate, etc., peroxides (such as hydrogen peroxide, benzoyl peroxide, cumene hydroperoxide, tertiary butyl peroxide, etc.), azo compounds (such as azobiscyanovaleric acid, azoisobutyronitrile, etc.), and redox initiators (such as hydrogen peroxide-iron (II) salt, potassium persulfate-sodium hydrogen sulfate, etc.). Common chain transfer agents or mixtures thereof known in the art, such as alkylmercaptans, can be used to control the polymer molecular weight.

When solution polymerization is employed, examples of suitable solvent medium include ketones such as methyl ethyl ketone, methyl butyl ketone, esters such as ethyl acetate, butyl acetate, ethers such as ethylene glycol monobutyl ether, and alcohols such as 2-propanol, and 1-butanol.

It is preferred to incorporate in the polymers comprising the core or shell portion of the core/shell polymer particles, or the soluble polymer, a certain amount of fluorinated or perfluorinated monomers. Such perfluorinated, ethylenically unsaturated monomers can contain a fluorocarbon group either directly bonded to an ethylenically unsaturated group or bonded to a hydrocarbon portion which is in turn bonded to an ethylenically unsaturated group. The bonding between the fluorocarbon group and the hydrocarbon portion may either be direct or through a bridging group such as a sulfonamido group. Examples of ethylenically unsaturated monomers are acrylate and methacrylate monomers. Typical fluorinated, ethylenically unsaturated monomers include:

$C_8F_{17}CH_2CH_2OOCC(CH_3)=CH_2$
$C_8F_{17}CH_2CH2N(CH_3)COCH=CH_2$
$C_8F_{17}CH_2CH_2OCOCH=CH_2$
$C_6F_{13}C_2H_4SCOCH=CH_2$
$C_8F_{17}SO_2N(C_2H_5)C_2H_4NHCOCH=CH_2$
$(CF_3)_2CF(CF_2)_8C_2H_2SCOC(CH_3)=CH_2$
$C_8F_{17}SO_2N(CH_3)C_2H_4COOCH=CH_2$
$C_8F_{17}SO_2N(CH_3)CH_2C_6H_4CH=CH_2$
$C_6F_{13}CH_2CH_2OOCC(=CH_2)COOCH_2CH_2C_6F_{13}$
$C_7F_{15}CH_2OOCCH=CHCOOCH_2C_7F_{15}$
$C_6F_{13}C_2H_4N(CH_2CH_2OH)COCH=CH_2$
$C_7F_{15}CON(C_2H_5)C_3H_6SCOC(CH_3)=CH_2$
$C_6F_{13}CH_2NHCOCH=CH_2$
$C_8F_{17}CH_2CH_2OCH=CH_2$
$(CF_3)_2CF(CF_2)_6CH_2CH(OH)CH_2COCH=CH_2$
$(CH_3)_2CFOC_2F_4OCOCH=CH_2$
$C_8F_{17}C_2H_4SO_2N(C_3H_7)C_2H_4OCOCH=CH_2$
$C_7F_{15}C_2H_4CONHC_4H_8OCOCH=CH_2$ $$C_3F_7(\underset{\underset{CF_3}{|}}{C}FCF_2O)_2\underset{\underset{CF_3}{|}}{C}FCH_2OCOCH=CH_2$$

$C_7F_{15}COOCH_2C(CH_3)_2CH_2OCOC(CH_3)=CH_2$
$C_8F_{17}SO_2N(C_2H_5)C_4H_8OCOCH=CH_2$
$(C_3F_7)_2C_6H_3SO_2N(CH_3)C_2H_4OCOCH=CH_2$
$C_8F_{17}CF=CHCH_2N(CH_3)C_2H_4OCOCH=CH_2$ as discussed in U.S. Pat. No. 5,380,644, incorporated by reference herein.

As the organic solvent, any of the members customarily used in coating compositions may be satisfactorily used. However, the preferred solvents for the practice of the present invention may include, for example, acetone, MEK, methanol, ethanol, butanol, Dowanol PM, iso-propanol, propanol, toluene, xylene, MIBK, and their mixtures. Among all the solvents, acetone, methanol, ethanol, iso-propanol, Dowanol PM, butanol, and propanol are most preferred.

Preferably the weight ratio of the soluble polymer to the core/shell polymer particles ranges from 5:95 to 40:60, and more preferably from 5:95 to 30:70. There is no limitation on the molecular weight of the polymers. However, preferably the molecular weight of the soluble polymer is lower than that of the polymer comprising the shell of the core/shell polymer particles.

Other additional compounds may be added to the coating composition, depending on the finctions of the particular layer, including surfactants, coating aids, matte particles, rheology modifiers, crosslinking agents, inorganic fillers such as metal oxide particles, pigments, antistatic agents, magnetic particles, biocide, lubricants, and the like. As previously discussed, a lubricant may alternatively be impregnated into the core portion of the core/shell polymer particles, as per U.S. Pat. No. 5,695,919. Suitable crosslinking agents include aldehydes, epoxy compounds, polyfunctional aziridines, vinyl sulfones, methoxyalkyl melamines, triazines, polyisocyanates, dioxane derivatives such as dihydroxydioxane, carbodiimides, and the like.

The coating composition of the invention can be applied by any of a number of well-know techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in Research Disclosure No. 308119, Published Dec. 1989, pages 1007 to 1008.

The amount of the total polymers applied in the backside protective overcoat is preferably in the range of from 0.01 to 10 $g/m^2$, and more preferably from 0.1 to 2 $g/m^2$.

In a particularly preferred embodiment, the photographic elements of this invention are photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (including pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994 and Research Disclosure, Item 38957 September 1996 herein incorporated by reference.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired. Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

A preferred photographic element according to the present invention comprises one or more silver halide light sensitive emulsion layers on one side of the support and the said backing protective layer present on the other side of the support as an outermost backing layer, or an outermost protective layer on the top of an abrasion resistance backing layer, or an outermost layer coated on the top of an antistatic layer, or an outermost layer coated on an magnetic recording layer. The backing protective layer can also comprise a lubricant.

According to a first embodiment said backside protective overcoat is applied on a support surface which is un-subbed or subbed with an adhesion promotion layer (primer layer). The unsubbed or subbed support surface can be pre-modified with treatment such as, for example, corona discharge, plasma, solvent etching, and the like.

According to a second embodiment said backside protective overcoat is applied on a support which employs an abrasion resistant backing layer that comprises, for example, an acrylic polymer, a cellulose derivative, a polyurethane, a mixture of film-forming and non-film forming polymer particles, a sol-gel material, and the like. Such abrasion resistant layer compositions have been described in, for example, U.S. Pat. Nos. 4,582,784, 5,045,394, 5,232,824, and 5,447,832.

According to a third embodiment said backside protective overcoat is applied on a support which contains an antistatic layer that comprises, for example, a highly crosslinked vinylbenzyl quaternary ammonium polymer and a hydrophobic binder described in U.S. Pat. No. 4,070,189, a highly conductive colloidal vanadium pentoxide described in U.S. Pat. Nos. 4,203,769, and 5,006,451, a conductive fine particle of crystalline metal oxides and a film-forming binder, a conductive metal antimonate and a film-forming binder described in U.S. Pat. No. 5,368,995, and the like.

According to a fourth embodiment said backside protective overcoat is applied on a support which contains a magnetic recording layer as described in, for example, U.S. Pat. No. 4,990,276; Research Disclosure, Item 34390, November 1992; and U.S. Pat. Nos. 5,395,743, 5,397,826, 5,113,903, 5,432,050, 5,434,037, and 5,436,120.

Another preferred imaging element according to the present invention comprises one or more silver halide emulsion layers on one side of the support and on the other side of the support the backside protective overcoat of the invention. The backside protective overcoat is used as an abrasion resistant backing layer, or an antistatic layer when it is applied together with an antistatic agent, or a magnetic recording layer when it is applied together with a magnetic recording particle.

A separate lubricant layer can be applied on the top of the backside protective overcoat of the invention. Lubricants which are useful for the practice of the invention include: (1) silicone based materials disclosed, for example, in U.S. Pat. Nos. 3,489,567, 3,080,317, 3,042,522, 4,004,927, and 4,047,958, and in British Pat. Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Pat. Nos. 1,263,722, 1,198,387, 1,430,997, 1,466,304, 1,320,757, 1,320,565, and 1,320,756, and in German Pat. Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly(trifluorochloroethylene), poly(vinylidene fluoride), poly(trifluorochloroethylene-co-vinyl chloride), poly(meth)acrylates or poly(meth)acrylamides containing perfluoroalkyl side groups, and the like.

The following examples are provided to illustrate the present invention in great detail, but in no way are intended to limit the scope thereof Polymers used in the example coatings are listed in Table 1 together with their composition (weight percent) and acid number. In Table 1, MMA is methyl methacrylate, EGD is ethylene glycol dimethacrylate, MA is methacrylic acid, AM is allyl methacrylate, EA is ethyl acrylate, and Zonyl TM is a fluoromonomer sold by DuPont de Nemours and Co.

TABLE 1

| Polymer | Composition | Acid Number |
|---|---|---|
| P-1 | Core/shell polymer particle | |
| | Core/shell: 70/30 | |
| | Core: MMA:EGD:AM = 85:10:5 | 0 |
| | Shell: MMA:MA = 90:10 | 65 |
| P-2 | Core/Shell polymer particle | |
| | Core/shell: 50/50 | |
| | Core: EA:EGD:AM = 94:1:5 | 0 |
| | Shell: MMA = 100 | 0 |
| P-3 | Soluble polymer | |
| | Poly(MMA-co-MA) | |
| | MMA:MA = 90:10 | 65 |
| P-4 | Soluble polymer | |
| | Poly(MMA-co-MA) | |
| | MMA:MA = 87.5:12.5 | 81 |

TABLE 1-continued

| Polymer | Composition | Acid Number |
|---|---|---|
| P-5 | Soluble polymer<br>Poly(MMA-co-MA)<br>MMA:MA = 85:15 | 98 |
| P-6 | Soluble polymer<br>Poly(MMA-co-MA-co-Zonyl TM)<br>MMA MA:Zonyl TM = 60:15:25 | 98 |

P-1 and P-2 are prepared according to procedures described in U.S. Pat. No. 5,597,680. P-3 through P-6 are prepared by emulsion polymerization. Resultant polymers are isolated, washed, and dried before use.

EXAMPLES 1 to 16

Coating formulations in acetone/methanol solvent mixtures comprising 5 wt % total solids (P-1 through P-6 and CN) are applied onto cellulose acetate support which has previously been coated with a vanadium pentoxide/cellulose nitrate containing antistatic layer prepared according to Example 1B of U.S. Pat. No. 5,356,468. CN is cellulose nitrate (40–60 second grade from Societe Nationale Powders and Explosives). The coatings are dried at 100° C. for one minute to give transparent films with a dry coating weight of 1 g/m$^2$.

It is known (described in U.S. Pat. Nos. 5,006,451 and 5,221,598) that the antistatic properties of the vanadium pentoxide layer are destroyed after photographic processing if not protected by an impermeable barrier. Thus the permeability or barrier properties of the example coatings can be evaluated by measuring the antistatic properties of the elements after processing in conventional C-41 photographic processing solutions. The internal resistivity (using the salt bridge method, described in R. A. Elder, "Resistivity Measurements on Buried Conductive Layer's", EOS/ESD Symposium Proceedings, September 1990, pages 251–254.) of the processed elements at 50% relative humidity is measured and compared with the internal resistivity before processing. The results are given in Table 2.

The surface haze or scum formation propensity is tested as follows: The example coatings are first processed in a C-41 processor and the dry processed strips are dipped in a C-41 stabilizer solution doctored with 500 ppm $CaCO_3$ equivalent, prepared by adding $CaCl_2$ $2H_2O$ and $NaHCO_3$ to the stabilizer solution. After dipping, the strips are hung to air-dry without rinsing or squeegying to remove excess liquid. The dried strips are evaluated under reflected and transmitted light for the presence of surface haze or scum. In Table 2, "none" refers to no scum or surface haze observed on the example coating surface, and "heavy" refers to heavy scum or surface haze observed on the example coating surface.

The scratch resistance of the example coatings is evaluated by the Taber Abrasion test in accordance with the procedure set forth in ASTM D1044.

"Excellent" refers to lower amounts of transmitted haze after Taber abrasion testing while "good" refers to higher haze levels.

TABLE 2

| | | Internal Resistivity log Ω/□ | | | |
|---|---|---|---|---|---|
| Coatings | Composition | Before C-41 Processing | After C-41 Processing | Scum or Surface Haze | Scratch Resistance |
| Example 1 (Comparison) | P-1 | 6.6 | 6.5 | Heavy | Excellent |
| Example 2 (Comparison) | P-2 | 6.6 | 6.7 | Heavy | Good |
| Example 3 (Comparison) | P-2/P-5 80/20 (wt/wt) | 6.6 | >12.5 | None | Good |
| Example 4 (Comparison) | P-2/P-4 70/30 (wt/wt) | 6.6 | >12.5 | None | Good |
| Example 5 (Comparison) | P-2/P-5 70/30 (wt/wt) | 6.6 | >12.5 | None | Good |
| Example 6 (Comparison) | P-1/P-6 98/2 (wt/wt) | 6.6 | 6.5 | Heavy | Excellent |
| Example 7 (Comparison) | P-1/P-3 80/20 (wt/wt) | 6.6 | 6.6 | Heavy | Excellent |
| Example 8 (Comparison) | P-1/P-3 70/30 (wt/wt) | 6.6 | 6.8 | Heavy | Excellent |
| Example 9 (Invention) | P-1/P-6 90/10 (wt/wt) | 6.6 | 7.3 | None | Excellent |
| Example 10 (Invention) | P-1/P-4 80/20 (wt/wt) | 6.6 | 6.6 | None | Excellent |
| Example 11 (Invention) | P-1/P-4 75/25 | 6.6 | 6.7 | None | Excellent |
| Example 12 (Invention) | P-1/P-4 70/30 (wt/wt) | 6.6 | 6.7 | None | Excellent |
| Example 13 (Invention) | P-1/P-5 85/15 (wt/wt) | 6.6 | 6.8 | None | Excellent |
| Example 14 (Invention) | P-1/P-5 80/20 (wt/wt) | 6.6 | 7.4 | None | Excellent |
| Example 15 (Comparison) | CN/P-5 75/25 | 6.6 | 6.7 | Heavy | Good |
| Example 16 (Comparison) | CN/P-5 25/75 | 6.6 | >12.5 | None | Good |

As seen in Table 2, Examples 9–14 show that the coating compositions of the invention provide highly transparent films with excellent resistance to surface haze or scum formation during photographic processing, excellent scratch resistance, and excellent protection (barrier properties) to an underlying antistatic layer from attack by film processing solutions. Comparative Examples 1–8, 15, and 16 show that it is difficult to simultaneously provide both barrier and surface haze or scum resistance properties. Comparative Example 16 shows that a film prepared according to U.S. Pat. No. 4,735,976 provides resistance to surface haze or scum, but does not provide barrier protection to an underlying antistatic layer. Comparative Examples 1–8 and 15 show that unless a core/shell polymer particle, with the appropriate acid content in the shell, is selected and blended in the correct proportion with a soluble polymer, which has the appropriate acid content, only one protective overcoat property, either barrier or scum resistance, may be fulfilled.

The invention has been described in detail with particular reference to certain preferred embodiments thereof, but it will be understood that variations and modifications can be effected within the spirit and scope of the invention.

What is claimed is:

1. A photographic element comprising:

a support having a frontside and a backside;

at least one silver halide emulsion layer superposed on the frontside of the support; and a protective overcoat layer superposed on the backside of the support, the protective overcoat formed from a coating solution comprising a continuous liquid organic medium having therein a mixture of dispersed core/shell vinyl polymer particles and a soluble vinyl polymer;

wherein the core/shell vinyl polymer particles comprise a core portion, which is insoluble in the organic medium, and a shell portion which has an affinity for both the core portion and the organic medium and has an acid number of from 25 to 200; and wherein the soluble vinyl polymer has an acid number of from 70 to 500 and the acid number of the soluble vinyl polymer is greater than the acid number of the shell of the core/shell vinyl polymer particles.

2. The photographic element of claim 1, wherein said core/shell vinyl polymer particles has a weight ratio of 75:25 to 50:50 with respect to the core portion: the shell portion.

3. The photographic element of claim 1, wherein the shell of the core/shell vinyl polymer particles has an acid number of from 40 to 150.

4. The photographic element of claim 1, wherein the soluble vinyl polymer has an acid number of from 80 to 250.

5. The photographic element of claim 1, having a weight ratio of soluble vinyl polymer to core/shell vinyl polymer particles of from 5:95 to 40:60.

6. The photographic element of claim 1, wherein the soluble vinyl polymer has a molecular weight lower than that of the shell of the core/shell vinyl polymer particles.

7. The photographic element of claim 1, wherein the protective overcoat layer further comprises surfactants, coating aids, matte particles, rheology modifiers, crosslinking agents, inorganic fillers, antistatic agents, pigments, magnetic particles, biocide, or lubricants.

8. The photographic element of claim 1, wherein the core portion of the core/shell polymer particles is impregnated with a lubricant.

9. The photographic element of claim 1 wherein the core/shell vinyl polymer particles and the soluble vinyl polymer comprise a dry coverage of from 0.01 to 10 $g/m^2$.

10. The photographic element of claim 1 wherein the polymer comprising the core or shell portion of the core/shell vinyl polymer particles further comprises fluorinated or perfluorinated monomers.

11. The photographic element of claim 1 wherein the soluble vinyl polymer further comprises fluorinated or perfluorinated monomers.

12. The photographic element of claim 1, further comprising a subbing layer interposed between the support and the protective overcoat layer.

13. The photographic element of claim 1, further comprising an abrasion resistant interposed between the support and the protective overcoat layer.

14. The photographic element of claim 1, further comprising an antistatic layer interposed between the support and the protective overcoat layer.

15. The photographic element of claim 1, further comprising a magnetic layer interposed between the support and the protective overcoat layer.

* * * * *

UNITED STATES PATENT AND TRADEMARK OFFICE

CERTIFICATE OF CORRECTION

PATENT NO. : 6,153,368
DATED : November 28, 2000
INVENTOR(S) : Dwight W. Schwark et al.

It is certified that error appears in the above-identified patent and that said Letters Patent is hereby corrected as shown below:

Title page,
Between items [73] and [21] insert the following:
-- [*] Notice: The term of this patent shall not extend beyond the expiration date of Patent No. 5,998,118. --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*